US009061349B2

(12) United States Patent
Lee et al.

(10) Patent No.: US 9,061,349 B2
(45) Date of Patent: Jun. 23, 2015

(54) INVESTMENT CASTING METHOD FOR GAS TURBINE ENGINE VANE SEGMENT

(71) Applicants: Ching-Pang Lee, Cincinnati, OH (US); Gerald L. Hillier, Charlottesville, VA (US); Jae Y. Um, Winter Garden, FL (US); Gm Salam Azad, Oviedo, FL (US)

(72) Inventors: Ching-Pang Lee, Cincinnati, OH (US); Gerald L. Hillier, Charlottesville, VA (US); Jae Y. Um, Winter Garden, FL (US); Gm Salam Azad, Oviedo, FL (US)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/073,922

(22) Filed: Nov. 7, 2013

(65) Prior Publication Data

US 2015/0122446 A1 May 7, 2015

(51) Int. Cl.
*B22C 9/10* (2006.01)
*B22D 25/02* (2006.01)

(52) U.S. Cl.
CPC .. *B22D 25/02* (2013.01); *B22C 9/10* (2013.01)

(58) Field of Classification Search
CPC ..... B22C 9/10; B22D 25/02
USPC ..... 164/15, 23, 24, 516, 47, 369
See application file for complete search history.

(56) References Cited

U.S. PATENT DOCUMENTS

| | | | | |
|---|---|---|---|---|
| 4,026,659 | A | 5/1977 | Freeman, Jr. | |
| 4,232,726 | A * | 11/1980 | Michelson | 164/12 |
| 4,321,010 | A * | 3/1982 | Wilkinson et al. | 416/92 |
| 6,142,734 | A | 11/2000 | Lee | |
| 7,322,795 | B2 * | 1/2008 | Luczak et al. | 416/96 A |
| 7,993,106 | B2 * | 8/2011 | Walters | 416/232 |
| 2005/0199365 | A1 | 9/2005 | Pfeifer et al. | |
| 2011/0132562 | A1 | 6/2011 | Merrill et al. | |
| 2011/0132563 | A1 | 6/2011 | Merrill et al. | |
| 2011/0132564 | A1 | 6/2011 | Merrill et al. | |

FOREIGN PATENT DOCUMENTS

WO 2012152525 A1 11/2012

* cited by examiner

*Primary Examiner* — Kevin P Kerns

(57) ABSTRACT

An investment casting method for a cast ceramic core (110), including an airfoil portion (116) shaped to define an inner surface (56) of an airfoil (52) of a vane segment (50) and an integral shell portion (122) having a backside-shaping surface (120) shaped to define a backside surface (68) of a shroud (62) of the vane segment. The backside-shaping surface has a higher elevation (132) and a lower elevation (134). The higher elevation is set apart from a nearest point (138) on the airfoil portion by the lower elevation. The airfoil portion and the shell portion are cast as a monolithic body during a single casting pour.

16 Claims, 8 Drawing Sheets

INVESTMENT CASTING METHOD FOR GAS TURBINE ENGINE VANE SEGMENT

FIELD OF THE INVENTION

The invention is related to casting of a cooled vane segment used in a gas turbine engine. Specifically, the invention relates to casting a monolithic ceramic casting core having a conventional core portion used to form an internal cooling channel in the airfoil of the vane segment plus a shroud external shell portion used to form a backside surface of the shroud of the vane segment.

BACKGROUND OF THE INVENTION

Industrial gas turbine engines include a compressor for compressing air, a combustor arrangement for combusting a mixture of fuel and the compressed air, and a turbine for extracting energy from the combustion gases. The turbine section includes rows of blades secured to a rotor shaft, all of which are turned by the combustion gases in the energy extraction process. Between the rows of turbine blades are rows of stationary vanes that properly orient the combustion gases as the combustion gases travel within the turbine. Each row of vanes includes vane segments, each of which has an inner shroud and an outer shroud secured to opposite ends of at least one airfoil. In many turbines the airfoils may be cooled via an internal cooling channel and backsides of the shrouds may also be cooled. These cooled airfoils may be part of the first and even second rows of turbine blades. Cooling may include convective cooling via a flow of cooling air over the surface to be cooled, and/or impingement cooling via an impingement plate inserts placed inside the airfoil's internal cooling channel and adjacent the backside of the shroud.

The airfoil and shrouds may be cast together thereby forming a monolithic vane segment. Alternately, the airfoil and shrouds may be case separately and then welded together. The airfoil's internal channel requires the use of a ceramic core to create the channel and define the internal surface configuration during the casting process. The remainder of the vane segment surfaces, including those of the inner and outer shrouds, is typically defined by a ceramic shell that is formed around a wax pattern of the vane segment, where the wax pattern is formed around the ceramic core. The wax pattern is then removed, leaving a void in the shape of the vane segment, where the ceramic core defines surface of the airfoil's interior channel and the ceramic shell defines the remainder of the surface of the vane segment.

Small features are desirable on some of the surfaces of the vane segment, including the airfoil's internal channel and the backside surface of the shroud, because they can be used in conjunction with impingement jets to improve the impingement cooling. The small features can be readily formed in the surface of the airfoil's internal channel by the ceramic core because the small features on the ceramic core survive the steps leading to the final casting, and are impressed directly onto the final vane segment. The small features on the backside surface of the shroud, however, would be formed by the wax pattern, since the wax pattern defines the backside surface of the shroud. The wax pattern is a soft material. For this reason if the small features are impressed on the surface of the wax pattern and then subject to the dipping process, during which the ceramic shell is formed, the small features are distorted and/or lost. Since small features in wax patterns cannot survive the dipping process, the surfaces of the vane segment that are defined by the shell, (which are, in turn, defined by the wax pattern), cannot have small features when the small features would result from a wax pattern that is exposed to the dipping process.

One technique that has been used to overcome this problem is to use a separately-cast, discrete ceramic insert to form the small features on the shroud backside surfaces. The wax pattern is formed around the ceramic core and the ceramic insert and the shell removed, leaving a void for the vane segment. In this method the ceramic core define the airfoil's internal surface and its small features, and the ceramic insert defines the shroud backside surface and its small features, and the remainder of the vane segment surface is formed by the shell. However, the position of the ceramic insert is difficult to control precisely and the quality of the casting is less than acceptable when a ceramic insert is used. For the foregoing reasons there is room in the art for improvement.

BRIEF DESCRIPTION OF THE DRAWINGS

The invention is explained in the following description in view of the drawings that show.

DETAILED DESCRIPTION OF THE INVENTION

The present inventors have devised a unique method and integral casting core through which fine features can be formed on a backside of a shroud of a cooled vane segment when an airfoil portion and the shroud portion (or portions) of the vane segment are simultaneously cast to form a monolithic, cooled, cast vane segment. The fine features may be heat transfer features that can be used in conjunction with impingement cooling jets to more effectively cool the shroud backsides. The method and casting core are enabled in some embodiments through the use of a flexible core die liner. The flexible liner makes it possible to incorporate features into a surface of a casting that are not possible when a rigid core die is used. This is because rigid core dies must be separated along a pull plane. When the die must be pulled apart while sliding along a surface of the casting the two surfaces cannot be shaped such that they interfere with that sliding. Due to the geometry of many parts, such as vane segments, this limits the places where fine feature can be formed into the casting, such as the shroud backside surface. The flexible liner inside the rigid core die obviates this problem because the flexible liner is used to form the fine features and the flexible liner can flex around the fine features as it is removed.

The inventors have taken advantage of this flexible liner to create the integral casting core that innovatively forms the cooling channel of the airfoil portion of the vane segment while simultaneously forming the backside surface of the shroud, which was previously formed either by a ceramic shell or a discrete, ceramic insert. Fine features may also be formed on the backside surface using the integral casting core because in this casting method the shroud backside, and hence any shroud backside surface features, are formed directly in the vane segment during casting by the integral core. Since the integral core is forming the fine features there is no concern about loss of the fine features when formed via the wax pattern or misalignment when formed via the discrete, ceramic inserts. Since the flexible liner can be pulled out from around small features that would prevent the separation of rigid core die liners, there is no concern about core die separation.

Figure 1:
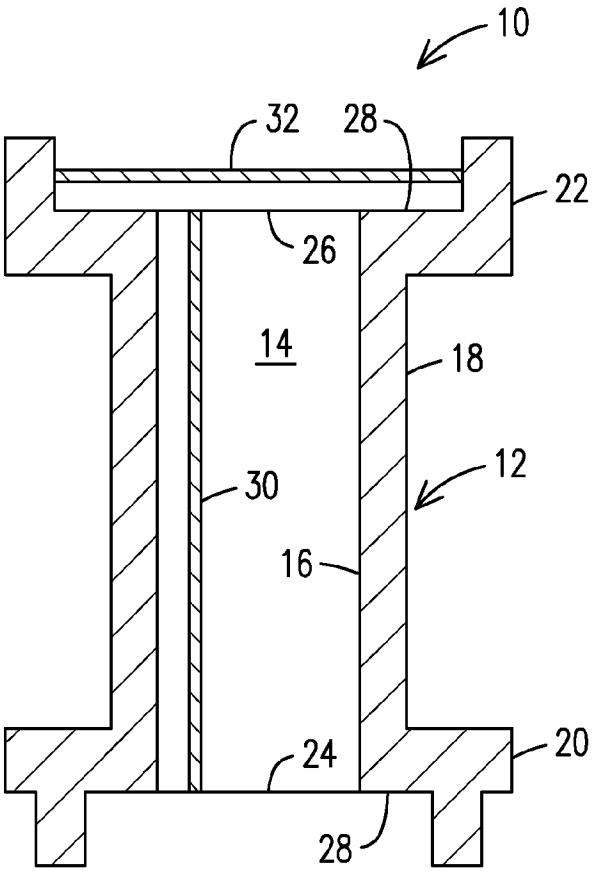
FIG. 1 PRIOR ART
FIG. 1 is a schematic cross-section of a prior art vane segment casting.

FIG. 1 is a schematic cross-section of a prior art vane segment 10 having an airfoil 12 with an airfoil internal channel 14, an airfoil inner surface 16, and an airfoil outer surface 18. An inner shroud 20 and an outer shroud 22 are disposed at an inner end 24 and an outer end 26 of the airfoil 12. The shrouds each have a respective backside surface 28 which is smooth, i.e. devoid of fine heat transfer features. An airfoil impingement insert 30 may be sued to form impingement jets used to cool the airfoil inner surface. A shroud impingement plate 32 may be used to form impingement jets used to cool the shroud backside surfaces 28.

Figure 2:
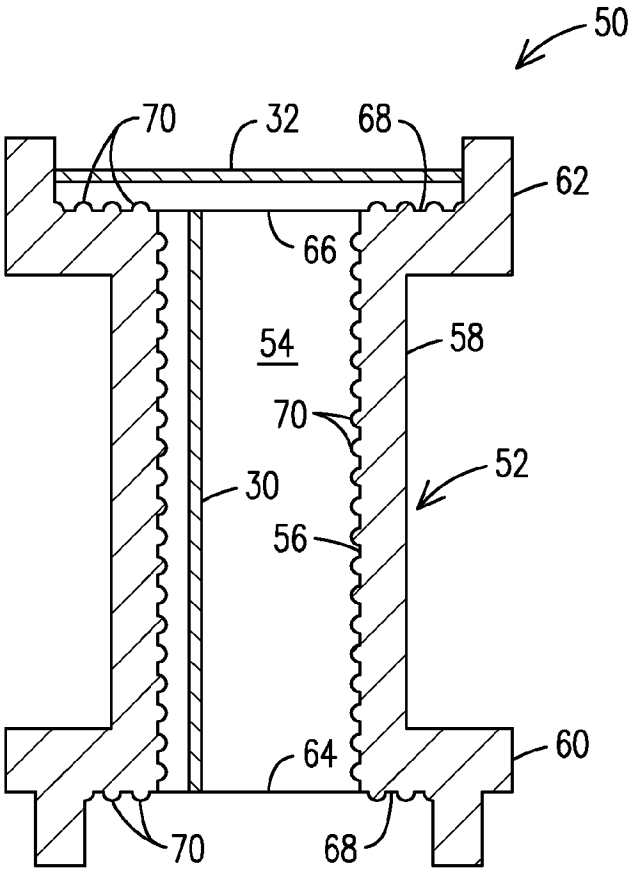
FIG. 2 is a schematic cross-section of a vane segment using the casting core and method disclosed herein.

FIG. 2 is a schematic cross-section of a high-temperature alloy vane segment 50 formed using the teachings herein. The vane segment 50 includes an airfoil 52 with an airfoil internal channel 54, an airfoil inner surface 56, and an airfoil outer surface 58. An inner shroud 60 and an outer shroud 62 are disposed at an inner end 64 and an outer end 66 of the airfoil 52. The shrouds each have a respective backside surface 68. Small features 70 may be formed into the airfoil inner surface 56 and/or one or both of the shroud backside surfaces 68. These small features 70 may be heat transfer features designed to work together with impingement jets formed by the airfoil impingement insert 30 and/or the shroud impingement plate 32. These small features 70 may take on any shape known to improve heat transfer, including arrays of repeated geometry such as an array of dimples. Alternately there may by various different sizes and shapes to the small features 70 that can be locally tailored as necessary to maximize heat transfer.

Figure 4A:
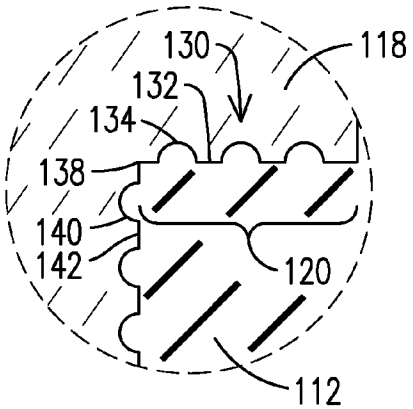
FIG. 4A is a close up of the detail of FIG. 4.
Figure 4:
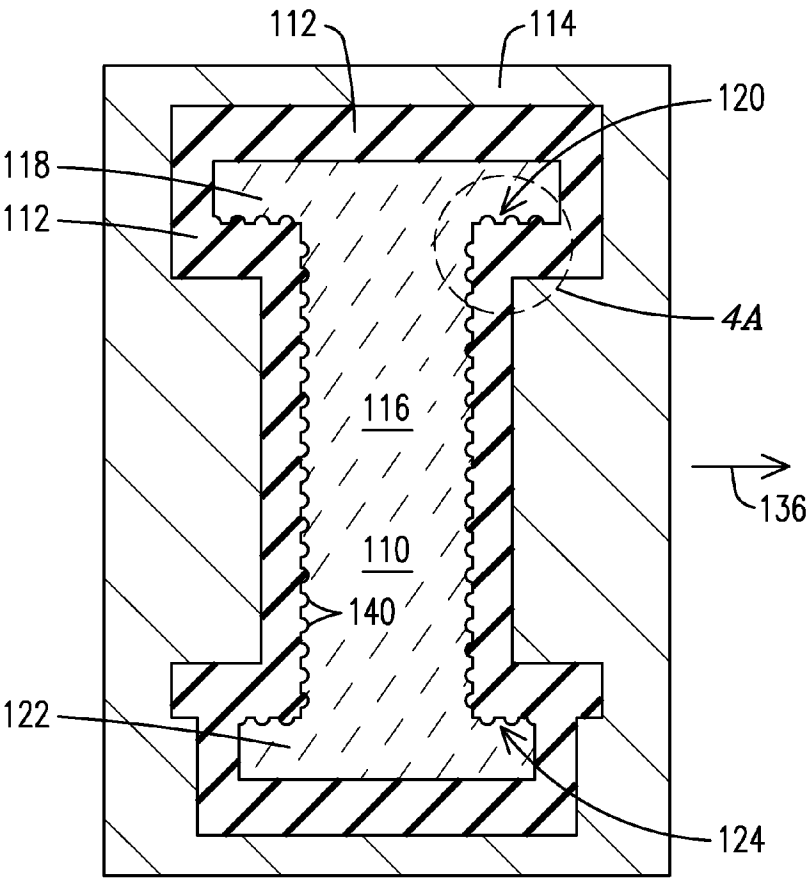
FIG. 4 is a schematic cross-section of an integral casting core having an airfoil portion and a shroud shell portion as cast in a core die having a flexible core die liner.
Figure 3:
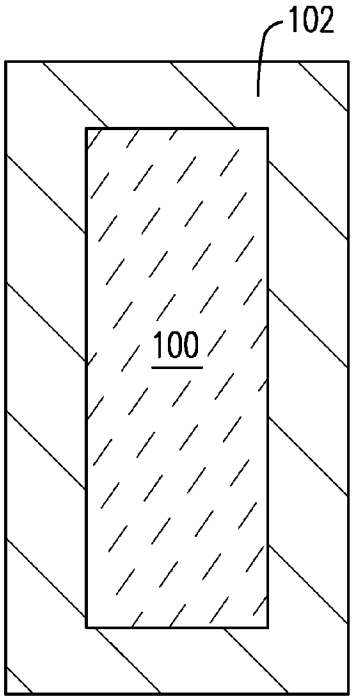
FIG. 3 PRIOR ART
FIG. 3 is a schematic cross-section of a prior art ceramic core as cast in a prior art core die.

FIGS. 3-16 schematically compare the prior art vane segment casting process and associated core to the process and associated core disclosed herein. FIG. 3 schematically depicts the formation of a prior art ceramic casting core 100 within a prior art rigid core die 102. FIG. 4 is a schematic cross-section of the integral casting core 110 as formed using a flexible liner 112 and an associated rigid core die 114. The integral casting core 110 includes a core airfoil portion 116 that defines the airfoil internal channel 54, and a shell portion 118 (outer shell portion) extending laterally from the core airfoil portion 116 and having a core shroud backside-shaping surface 120 that defines the backside surface 68 of the outer shroud 62. The integral casting core 110 may also include an opposing shell portion 122 (inner shell portion) extending laterally from the core airfoil portion 116 and having an opposing core shroud backside-shaping surface 124 that defines the backside surface 68 of the inner shroud 60. The core shell portions 118, 122 may have core shell features 130 that are configured to form the small features 70. The core airfoil portion 116 may have core airfoil features 140 that are configured to form the small features 70 on the airfoil inner surface 56. The core shell features 130 may include a higher elevation 132 and a lower elevation 134 adjacent to the higher elevations 132, where the elevation is relative to the respective core shell portion 118.

Due to the geometry of the integral casting core 110, if a rigid core die were used the rigid core die would need to be separated along line 136. However, when the core shell features 130 are configured as shown, where there is a lower elevation 134 between a higher elevation 132 and a nearest point 138 on a surface 142 of the core airfoil portion 116, an interference between the core shell features 130 and the opposite features in the rigid core die would prevent lateral movement between the core shell portion 118 and the rigid core die. This would necessarily prevent movement along line 136. However, the flexible liner is sufficiently flexible that it can be removed from around the core shell features 130 without causing any damage to them. Any pattern in the core shroud backside-shaping surface 120 that causes an interference that prevents separation of a rigid core die in this manner but which can be formed with the flexible liner 112 is envisioned. One such example would be an array of dimples, or recesses, or trip strips that are not aligned with line 136 etc.

Figure 6:
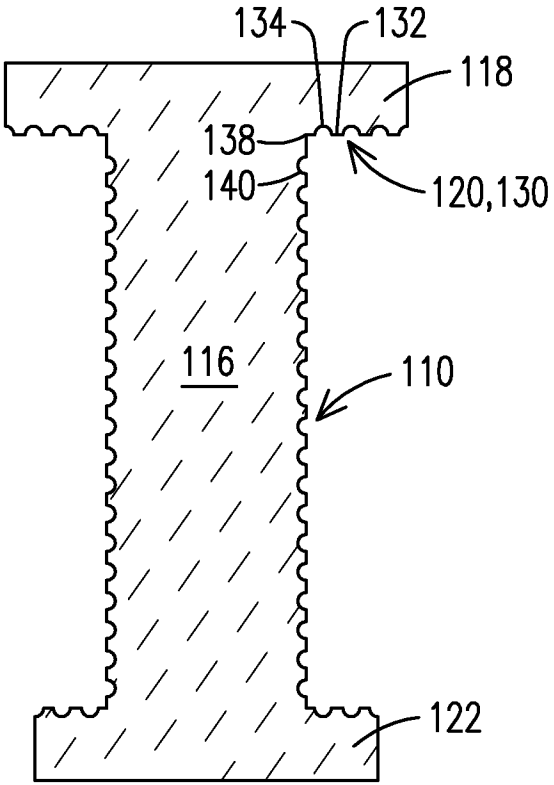
FIG. 6 is a schematic cross-section of the integral casting core of FIG. 4.
Figure 5:
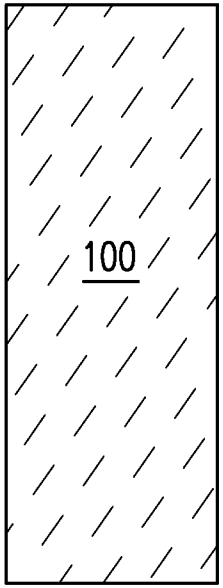
FIG. 5 PRIOR ART
FIG. 5 is a schematic cross-section of the prior art ceramic core of FIG. 3.

FIG. 5 is a schematic cross-section of the prior art ceramic casting core 100 of FIG. 3 with the prior art rigid core die 102 remove. The prior art ceramic casting core is removed as a green body and may be sintered at this point. FIG. 6 is a schematic cross-section of the integral casting core 110 with the flexible liner 112 and the associated rigid core die 114 removed. Likewise, the integral casting core 110 is removed as a green body and may be sintered at this point.

Figure 7:
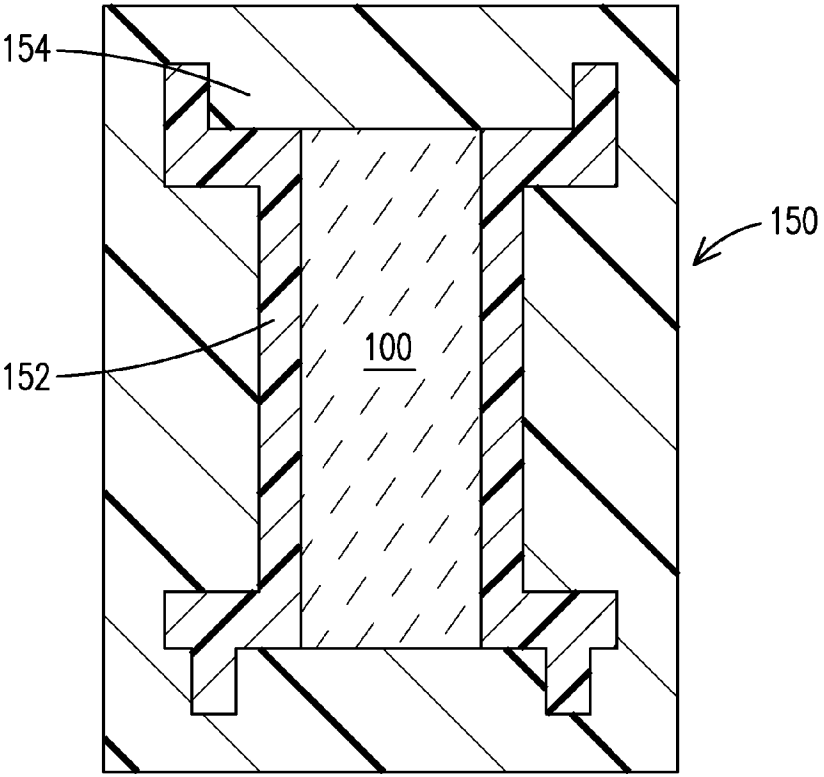
FIG. 7 PRIOR ART
FIG. 7 is a schematic cross-section of the prior art ceramic core of FIG. 5 positioned inside a prior art wax die, and a prior art wax pattern formed using the assembly.

FIG. 7 is a schematic cross-section of the prior art ceramic casting core 100 of FIG. 5 placed inside a prior art wax die 150, between which a prior art wax pattern 152 has been formed. The prior art wax pattern 152 is in the shape of the prior art vane segment 10 to be formed. Due to the geometry of the vane segment 50 to be formed, the geometry of the prior art wax die 150 includes a projection 154 into the prior art wax pattern 152. This projection 154 is a complexity of the prior art wax die 150 that makes its removal more difficult.

Figure 8:
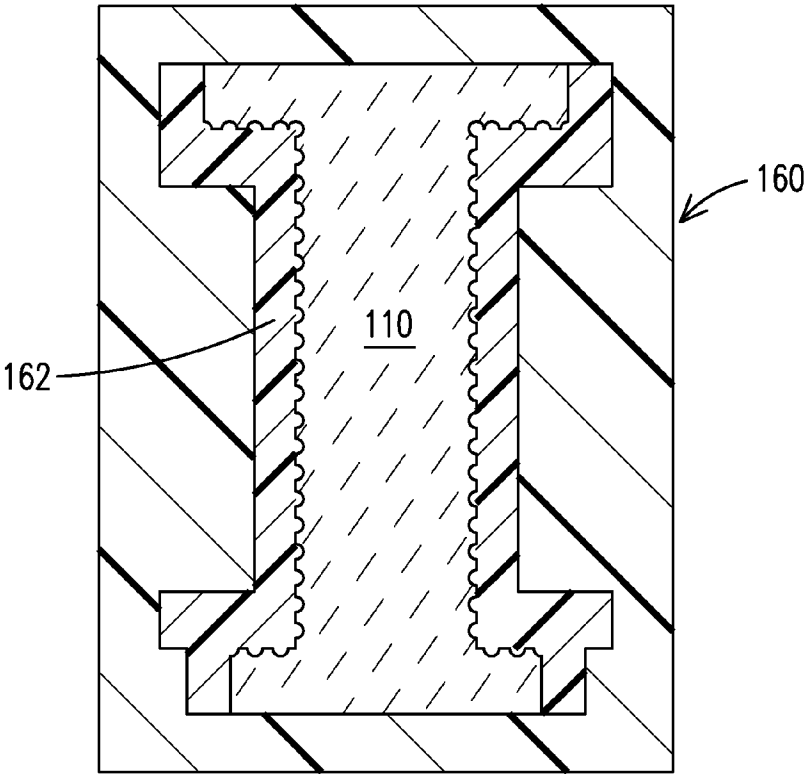
FIG. 8 is a schematic cross-section of the integral casting core of FIG. 6 positioned inside a wax die disclosed herein, and a wax pattern formed using the assembly.

FIG. 8 is a schematic cross-section of the integral casting core 110 of FIG. 6 inside a wax die 160, between which a wax pattern 162 has been formed. The wax pattern 162 is in the shape of the vane segment 50 to be formed. Due to the different shape of the integral casting core 110, the projection 154 of the prior art wax die 150 is not present. The result is an interior shape of the wax die 160 that is much simpler. This increased simplicity makes it easier to remove the wax die 160, and thereby increases available process options.

Figure 10:
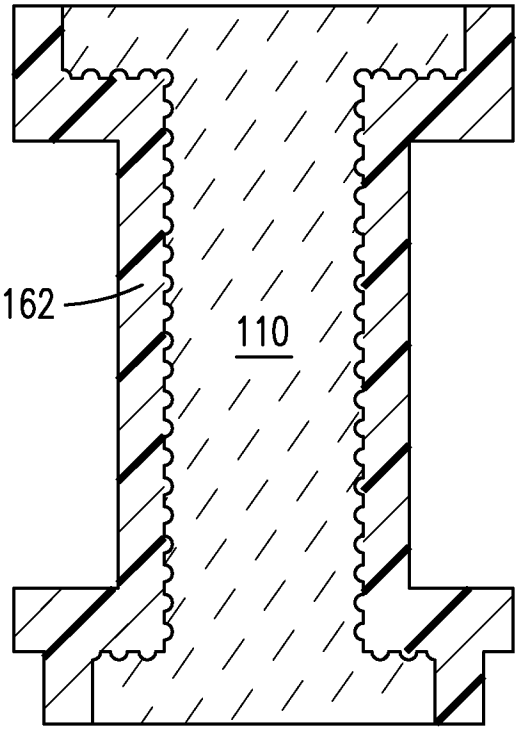
FIG. 10 is a schematic cross-section of the integral casting core and the wax pattern of FIG. 8.
Figure 9:
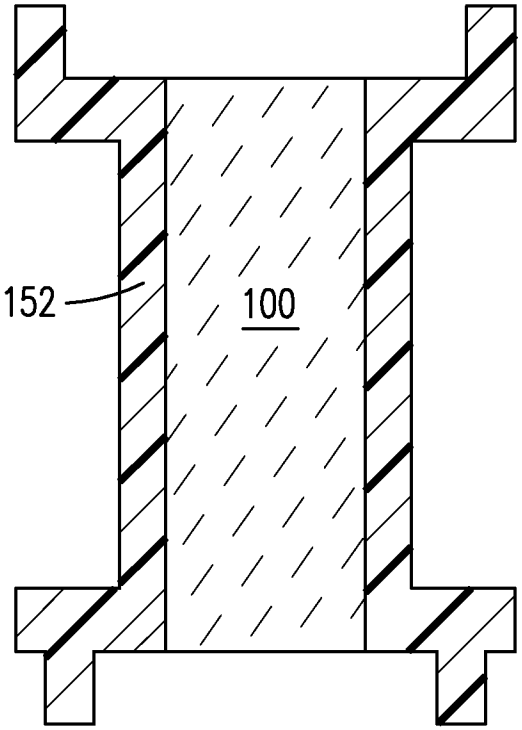
FIG. 9 PRIOR ART
FIG. 9 is a schematic cross-section of the prior art ceramic core and prior art ceramic pattern of FIG. 7.
Figure 12:
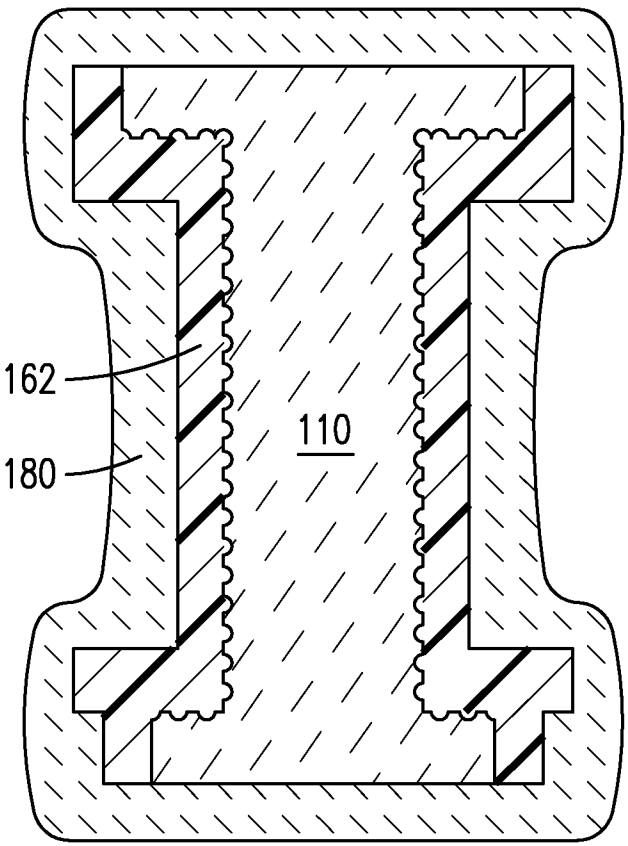
FIG. 12 is a schematic cross-section of the ceramic core and the wax pattern of FIG. 10 and a ceramic shell formed around the assembly.
Figure 11:
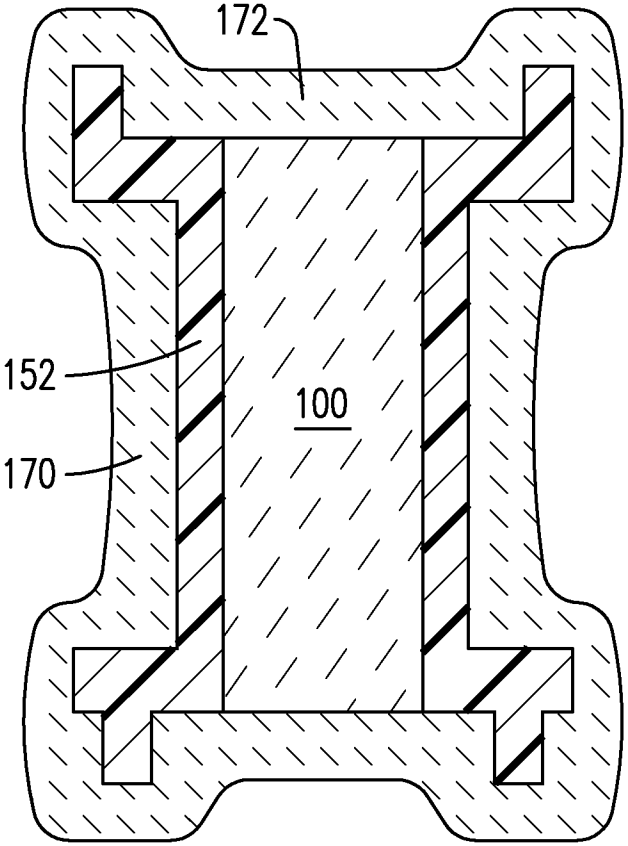
FIG. 11 PRIOR ART
FIG. 11 is a schematic cross-section of the prior art ceramic core and prior art ceramic pattern of FIG. 9 and a prior art ceramic shell formed around the assembly.

FIG. 9 is a schematic cross-section of the prior art ceramic casting core 100 and the prior art wax die 150 of FIG. 7 with the prior art wax die 150 removed. Similarly, FIG. 10 is a schematic cross-section of the integral casting core 110 and the wax pattern 162 of FIG. 8 with the wax die 160 removed. FIG. 11 is a schematic cross-section of the prior art ceramic casting core 100 and the prior art wax die 150 of FIG. 9 after a dipping process where a prior art ceramic shell 170 formed. Similar to the projection 154 of the prior art wax die 150, the prior art ceramic shell 170 includes a projection 172. FIG. 12 is a schematic cross-section of the integral casting core 110 and the wax pattern 162 of FIG. 10 after the dipping process where a ceramic shell 180 is formed. The projection 172 of the prior art ceramic shell 170 is no longer present. In those instances where the ceramic shell 180 forms a lower quality surface than does the integral casting core 110, eliminating the projection 172 reduces the amount of the vane segment 50 that is formed by the ceramic shell 172, and this represents an improvement to the vane segment 50.

Figure 14:
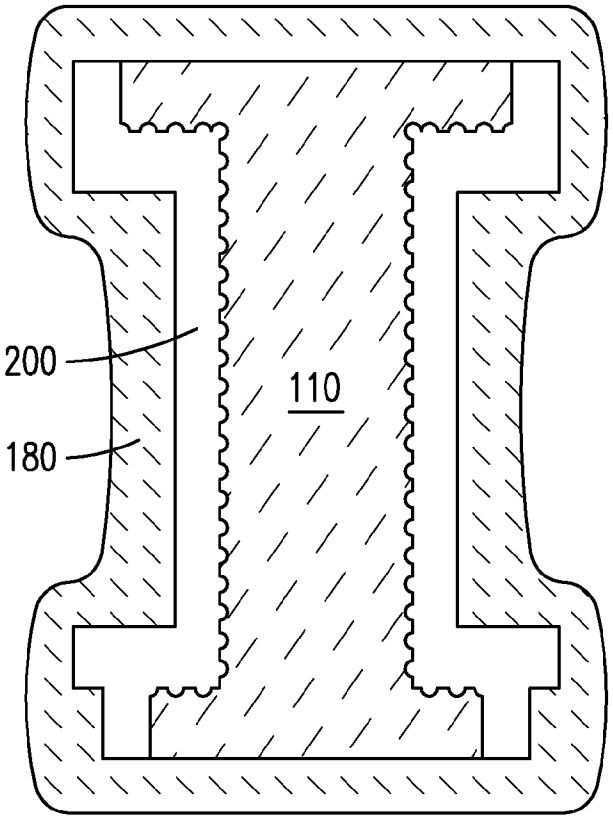
FIG. 14 is a schematic cross-section of the integral casting core and ceramic shell of FIG. 12, with a void for the vane segment.
Figure 13:
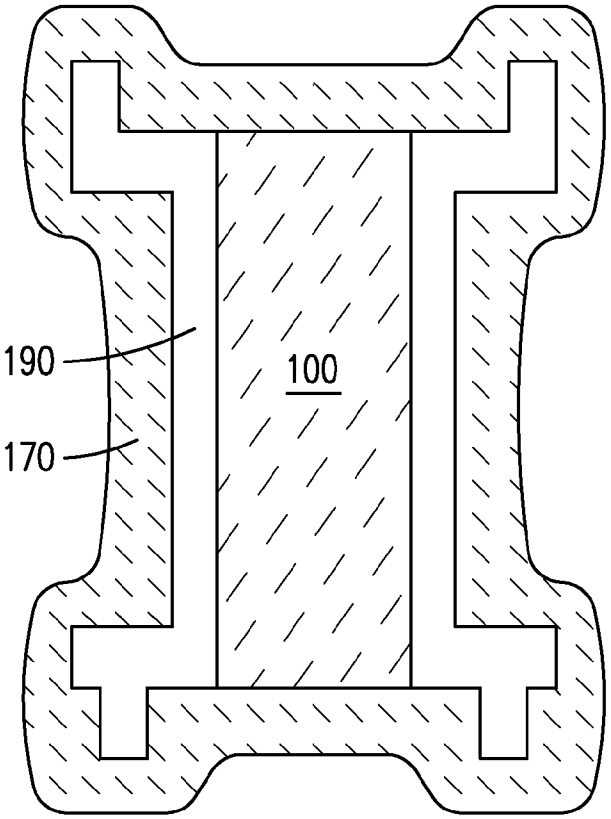
FIG. 13 PRIOR ART
FIG. 13 is a schematic cross-section of the prior art ceramic core and prior art ceramic shell of FIG. 11, with a void for the prior art vane segment.

FIG. 13 is a schematic cross-section of the prior art ceramic casting core 100 and the prior art ceramic shell 170 of FIG. 11, with the prior art wax pattern 152 removed. This leaves a prior art void 190 into which molten alloy will be poured during a single casting pour in order to form the prior art vane segment 10. FIG. 14 is a schematic cross-section of the integral casting core 110 and the ceramic shell 180 of FIG. 12, with the wax pattern 162 removed. This leaves a void 200 into which molten alloy will be poured during a single casting in order to form the monolithic, integral casting core 110.

Figure 15:
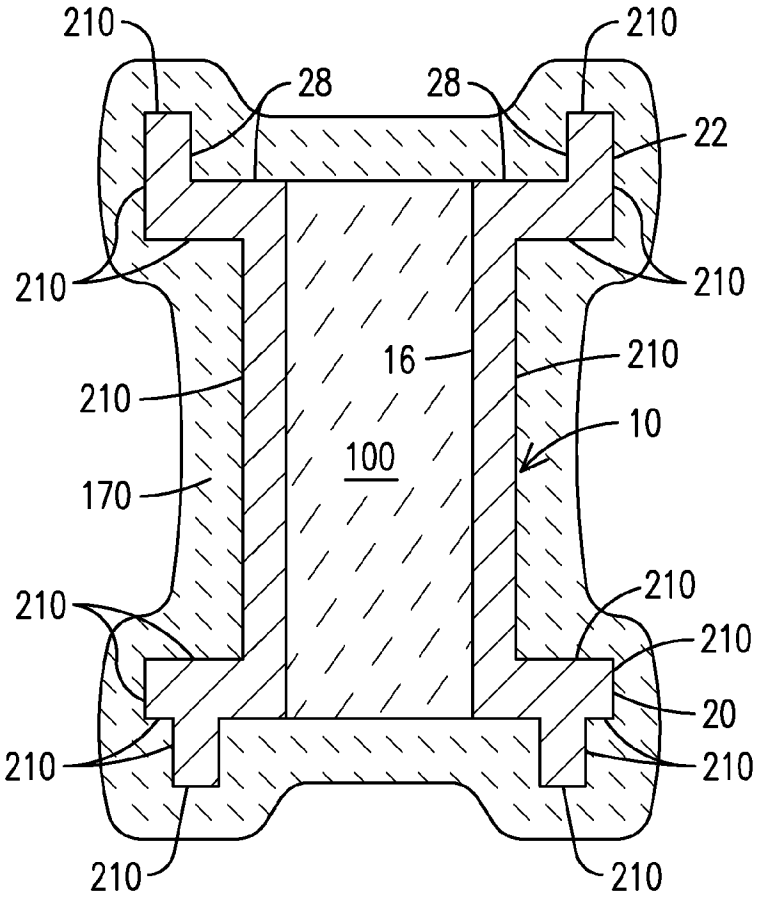
FIG. 15 PRIOR ART
FIG. 15 is a schematic cross-section of the prior art ceramic core and the prior art ceramic shell of FIG. 11, and a prior art vane segment cast therein.

FIG. 15 is a schematic cross-section of the prior art ceramic casting core 100 and the prior art ceramic shell 170 of FIG. 13 and the prior art vane segment 10 that has been cast in the prior art void 190. In this prior art investment casting process (lost-wax casting) the prior art ceramic shell 170 forms all exterior surfaces 210 as well as the backside surfaces 28 of the shrouds 20, 22. The prior art ceramic casting core 100 is limited to forming the airfoil inner surface 16.

Figure 16:
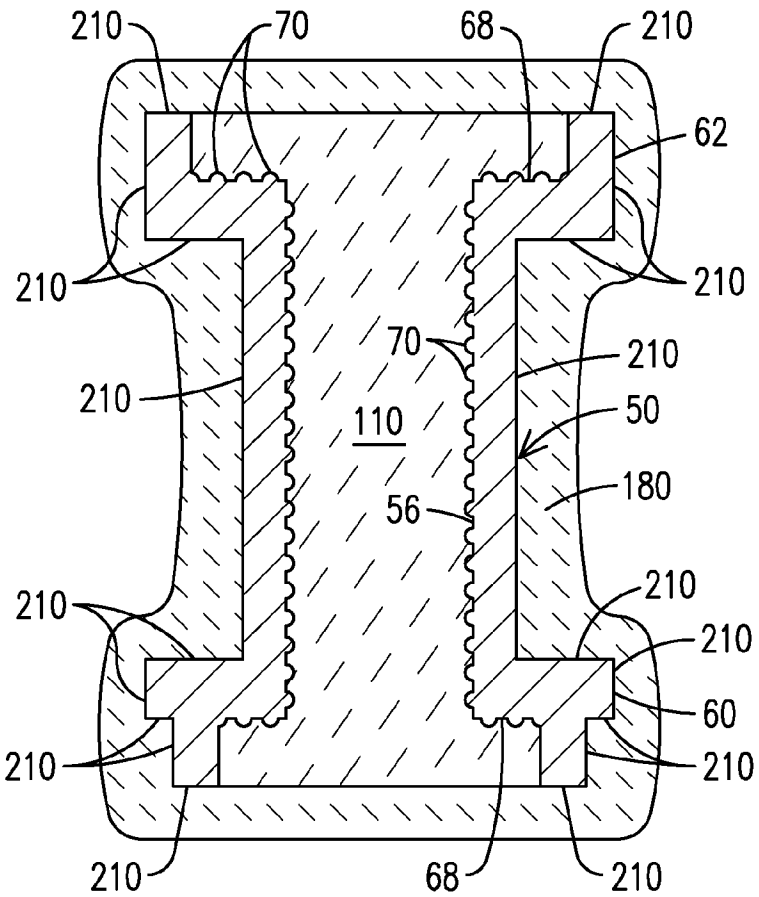
FIG. 16 is a schematic cross-section of the integral casting core and ceramic shell of FIG. 14, and a vane segment cast therein.

FIG. 16 is a schematic cross-section of the integral casting core 110 and the ceramic shell 180 of FIG. 14 and the vane segment 50 that has been cast into the void 200. In the method disclosed herein the integral casting core 100 now not only forms the airfoil inner surface 56, but it also forms the backside surfaces 68 of the shrouds 60, 62. The ceramic shell 180 is now limited to forming external surfaces 210. This change allows for the surface features 70 to be formed on the backside surfaces 68 of the shrouds 60, 62, via the same casting that forms the airfoil internal channel 54, which has not been done before. The surface features 70 will not wash out as may happen when the surface features 70 are formed into the prior art ceramic shell 170 via the prior art wax pattern 152, and will not reposition as may happen when the surface features 70 are formed using a prior art ceramic insert. For this reason the surface features 70 may be made more fine than has been possible until now. Consequently, this represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An investment casting method for forming an alloy gas turbine engine vane segment, wherein the improvement comprises forming a monolithic cast ceramic core comprising: a core airfoil portion comprising an airfoil portion pressure side and an airfoil portion suction side; a first core shell portion disposed at a first end of the core airfoil portion and extending transverse to and beyond both the airfoil portion pressure side and the airfoil portion suction side, wherein the first core shell portion comprises a core shroud backside-shaping surface oriented transverse to the core airfoil portion, facing an opposite end of the core airfoil portion, and comprising a core shell feature, the core shroud backside-shaping surface configured to define at least a portion of a backside surface of a shroud of the vane segment, and wherein the core shell feature defines a peak disposed closer to the opposite end of the core airfoil portion and a recess disposed farther from the opposite end of the core shell portion and between the peak and the core airfoil portion.

2. The method of claim 1, wherein the improvement further comprises forming the vane segment using the cast ceramic core, wherein the vane segment comprises an airfoil, an inner shroud, and an outer shroud, and inner and outer shroud interior backside surfaces exposed to cooling air during operation in the gas turbine engine.

3. The method of claim 1, wherein the improvement further comprises forming a wax pattern around the cast ceramic core, then forming a dipped ceramic shell around the wax pattern and cast ceramic core, then removing the wax pattern to form a void, and then casting a vane segment in the void, wherein the shell is configured to define only external surfaces of the vane segment.

4. The method of claim 1, wherein the improvement further comprises casting the monolithic, ceramic core within a flexible core die liner.

5. The method of claim 4, wherein the improvement further comprises forming an array of raised or lowered core shell features in the core shroud backside-shaping surface via an array of flexible liner shell features formed in a surface of the flexible core die liner that at least partly defines the first core shell portion, wherein the array of core shell features is configured to form an array of heat transfer features in the backside surface of the shroud of the vane segment.

6. The method of claim 5, wherein an interlocking of at least one core shell feature with at least one flexible liner shell feature prevents separation of the flexible core die liner from the cast ceramic core without deforming the flexible core die liner.

7. The method of claim 4, wherein the improvement further comprises forming an array of raised or lowered core airfoil features in the core airfoil portion via an array of flexible liner airfoil features formed in a surface of the flexible core die liner that at least partly defines the core airfoil portion, wherein the core airfoil features are configured to form an array of heat transfer features in a surface of the airfoil of the vane segment.

8. A method, comprising:

casting a vane segment comprising an inner shroud and an outer shroud each comprising respective interior backside surfaces exposed to cooling air during operation of the gas turbine, wherein the vane segment is cast around a monolithic, cast ceramic core, the method further comprising casting the cast ceramic core within a flexible core die liner, wherein the ceramic core comprises: a core airfoil portion shaped to define an interior surface of an airfoil of the vane segment and comprising an airfoil portion pressure side and an airfoil portion suction side; a first core shell portion disposed at a first end of the core airfoil portion and extending transverse to both the airfoil portion pressure side and the airfoil portion suction side; and an opposing core shell portion disposed at an opposite end of the core airfoil portion and extending transverse to both the airfoil portion pressure side and the airfoil portion suction side, wherein the cast ceramic core forms the interior backside surfaces, wherein the first core shell portion comprises a core shroud backside-shaping surface oriented transverse to the core airfoil portion, facing the opposing core shell portion, and comprising a core shell feature, and wherein an interlocking of the core shell feature and the flexible core die liner prevents separation of the flexible core die liner from the cast ceramic core without deforming the flexible core die liner.

9. The method of claim 8, further comprising:

forming an array of elevated or lowered shroud heat transfer features on a backside surface of a shroud of the vane segment via an array of elevated or lowered core shell features formed in the first core shell portion.

10. The method of claim 8, further comprising:

forming an array of elevated or lowered airfoil heat transfer features on an interior surface of the airfoil of the vane segment via an array of elevated or lowered core airfoil features formed in the core airfoil portion.

11. The method of claim 8, further comprising:

forming an array of raised or lowered core shell features in the first core shell portion via an array of raised or lowered flexible liner shell features in a surface of the flexible core die liner that at least partly defines the first core shell portion, wherein the core shell features are configured to form an array of raised or lowered heat transfer features in a backside surface of the shroud of the vane segment.

12. The method of claim 8, further comprising:

forming an array of raised or lowered core airfoil features in the core airfoil portion via an array of raised or lowered flexible liner airfoil features in a surface of the flexible core die liner that at least partly defines the core airfoil portion, wherein the array of core airfoil features is configured to form an array of raised or lowered heat transfer features in an interior surface of the airfoil of the vane segment.

13. A method, comprising:

casting a monolithic ceramic core within a flexible core die liner, wherein the ceramic core comprises: a core airfoil portion comprising an airfoil portion pressure side and an airfoil portion suction side shaped to define an interior surface of an airfoil of a vane segment; a first core shell portion disposed at a first end of the core airfoil portion and extending transverse to both and beyond the airfoil portion pressure side and the airfoil portion suction side, the first core shell portion comprising a core shroud backside-shaping surface oriented transverse to the core airfoil portion, facing an opposite end of the core airfoil portion, and comprising an array of core shell features; and an opposing core shell portion disposed at the opposite end of the core airfoil portion and extending transverse to and beyond both the airfoil portion pressure side and the airfoil portion suction side, wherein the array of core shell features defines a peak disposed closer to the opposite end of the core airfoil portion and a recess disposed farther from the opposite end of the core airfoil portion and between the peak and the core airfoil portion, effective to prevent removal of the flexible core die liner without first deforming the flexible core die liner.

14. The method of claim 13, wherein the array of core shell features is shaped to define an array of heat transfer features on a backside surface exposed to cooling air during operation of a shroud of the vane segment.

15. The method of claim 14, further comprising:

forming an array of core airfoil features as part of the core airfoil portion, wherein the array of core airfoil features is shaped to define an array of heat transfer features on the interior surface of the airfoil.

16. The method of claim 13, further comprising:

forming an array of core airfoil features as part of the core airfoil portion, wherein the array of core airfoil features is shaped to define an array of heat transfer features on the interior surface of the airfoil.

* * * * *